US006095794A

United States Patent [19]

Jamieson et al.

[11] Patent Number: 6,095,794

[45] Date of Patent: Aug. 1, 2000

[54] FIREPLACE BURNER APPARATUS

[76] Inventors: Donald Reginald Jamieson, 1420 Aldercrest Court, Oakville, Ontario, Canada, L6M 1X3; Susan Leslie Birtch, 136 Dixon Road, Etobicoke, Ontario, Canada, M9P 2L6; Claudia Maria Dwyer, 36 West Hampton Drive, Etobicoke, Ontario, Canada, M9R 1X6

[21] Appl. No.: 09/009,594

[22] Filed: Jan. 20, 1998

Related U.S. Application Data

[60] Provisional application No. 60/036,344, Jan. 23, 1997.

[51] Int. Cl.[7] ..... F23D 14/00

[52] U.S. Cl. ..... 431/125; 126/512; 239/556; 431/354

[58] Field of Search ..... 431/354, 7, 326, 431/328, 125; 126/512; 239/556, 135, 568

[56] References Cited

U.S. PATENT DOCUMENTS

| | | | |
|---|---|---|---|
| 485,079 | 10/1892 | Backus | 126/512 |
| 973,498 | 10/1910 | Geurink . | |
| 1,132,029 | 3/1915 | O'Dowd | 239/568 |
| 1,830,393 | 11/1931 | Geurink et al. | 239/568 |
| 3,186,644 | 6/1965 | Ross et al. | 239/534 |
| 4,305,372 | 12/1981 | Hahn | 126/41 R |
| 4,622,946 | 11/1986 | Hurley et al. | 126/214 D |
| 4,726,351 | 2/1988 | Whittaker et al. | 126/127 |
| 5,000,162 | 3/1991 | Shimek et al. | 431/125 |
| 5,052,370 | 10/1991 | Karabin | 126/512 |
| 5,081,981 | 1/1992 | Beal | 126/92 |
| 5,249,958 | 10/1993 | Freber | 431/354 |
| 5,320,520 | 6/1994 | Barth et al. | 431/125 |
| 5,328,356 | 7/1994 | Hawkinson | 431/125 |
| 5,388,566 | 2/1995 | Smith et al. | 126/512 |
| 5,392,763 | 2/1995 | Shaw et al. | 126/512 |
| 5,399,084 | 3/1995 | McCullough et al. | 431/125 |
| 5,452,709 | 9/1995 | Mealer | 431/125 |
| 5,479,916 | 1/1996 | Shimek et al. | 126/512 |
| 5,571,008 | 11/1996 | Richardson et al. | 431/125 |
| 5,601,073 | 2/1997 | Shimek | 126/512 |
| 5,622,491 | 4/1997 | Van Belle | 431/328 |
| 5,645,409 | 7/1997 | Ni et al. | 431/125 |
| 5,647,342 | 7/1997 | Jamieson et al. | 126/512 |
| 5,671,727 | 9/1997 | Squires et al. | 126/512 |
| 5,688,568 | 11/1997 | Wolf et al. | 431/125 |
| 5,722,824 | 3/1998 | Beck | 431/125 |
| 5,746,588 | 5/1998 | Binzer | 431/354 |
| 5,931,154 | 3/2000 | Hussong et al. | 126/512 |
| 5,988,159 | 11/1999 | Blount | 126/512 |
| 6,006,742 | 12/1999 | Jamieson et al. | 126/512 |
| 6,036,474 | 3/2000 | Diep et al. | 431/125 |

FOREIGN PATENT DOCUMENTS

| | | | |
|---|---|---|---|
| 0096111 | 12/1983 | European Pat. Off. | 431/125 |
| 52-24336 | 2/1977 | Japan . | |
| 1433771 | 4/1976 | United Kingdom . | |
| 1313721 | 4/1979 | United Kingdom . | |
| 2284475 | 6/1995 | United Kingdom . | |
| 2174490 | 11/1998 | United Kingdom | 126/92 R |

*Primary Examiner*—Ira S. Lazarus
*Assistant Examiner*—Sara Clarke
*Attorney, Agent, or Firm*—W. Kirk McCord

[57] ABSTRACT

An improved fireplace assembly is described having a folded sheet metal burner manifold divided into three regions, being an upper burner, a lower burner and an intermediate communicating riser. This single manifold chamber is provided with two separate gas inlets, each of which may deliver a different primary air to fuel mix suitable for use with an array of burner ports and an associated set of simulated logs to create different sizes and shapes of flames, or flame patterns. The flame patterns generate hot exhaust gases which heat portions of the simulated logs to glow. The burner ports used in the assembly to generate suitably attractive flame displays may include large or non-circular apertures or slots having local reinforcement to resist deformation of those apertures.

14 Claims, 7 Drawing Sheets

'5'
'L'
74c
74
78b
68b
48
68
70
76c
62c
66c
62
34
46
66
60
88
44
72
86
62b
66b
92
52
76b
72a
178
74b
54
40
124
126
84
42
74a
78a
90
62a
44
66b
64
66a
74
70
48
68
68c
46
50
78a
78
68a
72a
76
38
34
36
66c
68b
72d
76c
60
44
34
48
66
72a
68c
76b
56
72c
68
64
48
76a
66a
68a
72
46
72b

Fig. 6.
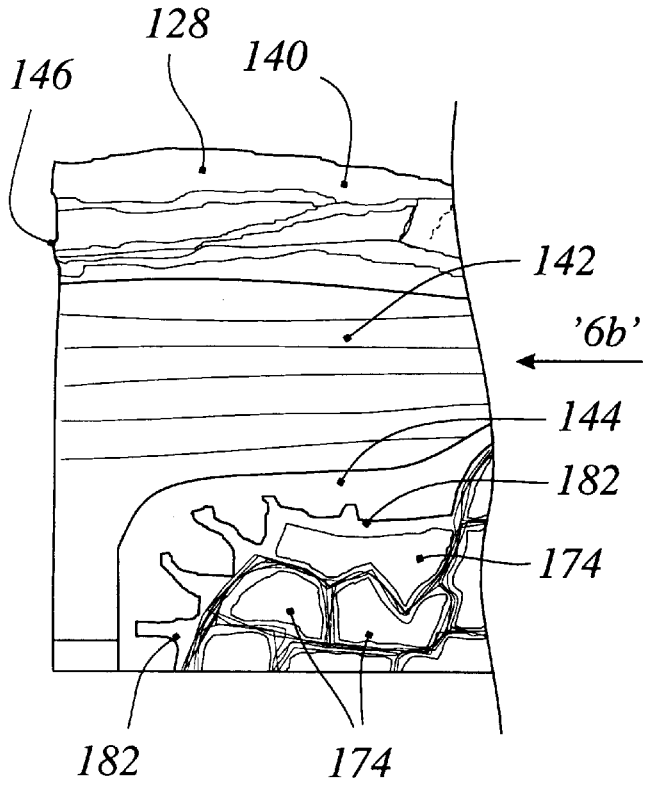
Fig. 6a.
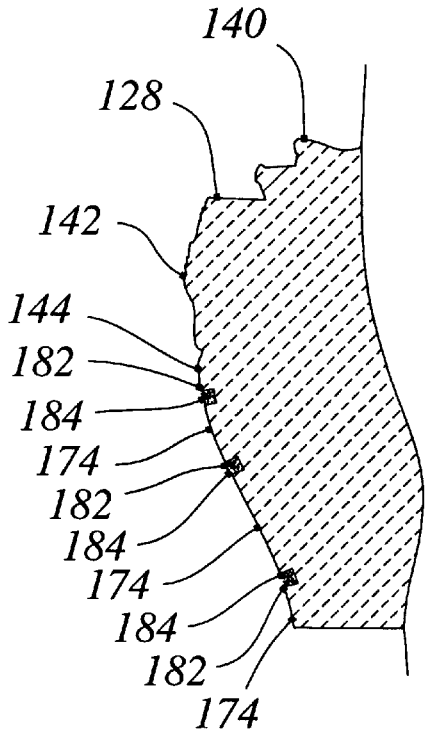
Fig. 6b.

FIREPLACE BURNER APPARATUS

This application claims the benefit of U.S. Provisional Application Ser. No. 60/036,344 filed Jan. 23, 1997.

FIELD OF INVENTION

This invention relates generally to a combustion apparatus having a visible fire display, and more specifically to burner manifolds and displays for gas fireplaces. In particular it relates to such gas burner manifolds as may present an array of burner jets oriented generally toward an arrangement of simulated solid fuel materials, and most particularly those manifolds for use with a simulated wood log display having more than one level and which may include embedded emberizing material disposed for interaction with burner exhaust gases.

BACKGROUND ART

Gas fireplaces generally include a casing for containing the fire, a firebox mounted within the casing in a manner which permits air from inside a dwelling to circulate thereabout and be warmed, a gas burner for connection to a gas supply, and an arrangement of simulated solid fuel material located relative to the burner in a manner which gives an aesthetically pleasing natural fire appearance when in use. The casing and firebox are provided with an opening and a window respectively, by which means persons may view the fire. In some instances the simulated solid fuel is arranged to have the appearance of a coal fire, or bed of coals. In North America simulated wood log fires predominate.

The nature of simulated fire displays is such that it may be advantageous to locate the simulated logs in a generally rearwardly ascending display such that more of the fire is visible. Most commonly the simulated logs are arranged in a tier-like fashion. However the logs or coals may be arranged, it is generally desirable to produce a corresponding flame display in a manner which gives the appearance of the entire log set burning. The careful matching of burners to simulated log or simulated coal arrangements to produce aesthetically pleasing results is a science of much subtlety.

It is known to direct gas jets against simulated log or ember materials to simulate the appearance of glowing coals, and that cooler flames have a more yellow appearance similar to the appearance of a natural wood fire. However, it is also known that directing flames to impinge upon relatively cool high thermal mass ceramic or concrete logs may lead to incomplete combustion, sooting, and unacceptable pollutant emissions. One technique used to produce simulated glowing embers is to place a gas manifold in or beneath a bed of emberizing material, such as low density rock wool. Another technique is to direct flames at soft ceramic material, whose surface then glows. In either case a stable flame pattern may yield a constantly glowing body rather than a flickering effect.

The production of a glowing portion of a log, or an ember strip, or a bed of simulated glowing coals often requires the careful placement of ember simulating materials relative to flames emanating from a burner. In some instances the glowing material is loosely deposited on the burner itself, or in a tray about the burner. The glow produced may also vary on the installation of a log set on delivery, a relatively small change in the spacing between logs, or their relative angles of placement, may result in an unexpected hot or cool spot. It is advantageous to control the relative dimensions of adjacent glowing and non-glowing elements to reduce the likelihood of such unexpected results.

The problem of rearwardly ascending logs may be addressed by providing a rearwardly ascending burner, such as the two-run U-tube burner in U.S. Pat. No. 5,081,981 issued Jan. 21, 1992 to Beal. or the H-shaped welded burner of U.S. Pat. No. 5,052,370 issued Oct. 1, 1991 to Karabin. Another alternative is to employ fore and aft burners, as in U.S. Pat. No. 5,388,566 issued Feb. 14, 1995 to Smith et al.

A disadvantage of such tube run burners is that they may yield the appearance of a straight line, or curtain of flame, rather than a more random natural appearance. One attempt to give a more random effect is shown in U.S. Pat. No. 5,392,763 issued Feb. 28, 1995 to Shaw et al., in which each of a plurality of pipes having a plurality of openings follows a twisted path to a desired location. Another attempt to give a more random flame distribution is to use a pan burner with more randomly located openings, be they pinholes or slots, designed to match a less tier-like log set, such as is shown in U.S. Pat. No. 4,726,351 issued Feb. 23, 1988 to Whittaker et al., or U.S. Pat. No. 5,671,727 of Squires et al., laid open Jun. 24, 1996.

As noted above, it may be desirable to have a burner flame port in a configuration other than a pinhole. Holes formed by drilling, piercing, slitting, laser cutting and other conventional means are well known. The aspect ratio of a slot is defined as the ratio of its characteristic length to its characteristic width, whether those characteristic dimensions are the length and width of a rectangular slot, the arc length and width of a non-linear slot, or the major and minor axes of an oval or elliptical slot. The repeated heating and cooling cycles of pan burners, often with local hot and cool spots, may lead to deformation of the burner, and in particular, to deformation of the top sheet of the burner over time. An apparently minor distortion adjacent to an high aspect ratio slot may yield undesired changes in the flame patterns, and pollutants, produced. It is advantageous not only to maintain the geometric relationship of the various heated and glowing members, but also to maintain slot geometry.

It is known to provide pan burners with internal baffling, brackets, top hat sections, and even dead air-space walls. This has the disadvantage of increasing the number of parts required and the number of assembly operations, and it is generally desirable to avoid a large number of internal parts. The use of drawing and punching techniques before assembly reduces the need for extra parts, and permits local stiffening of the burner panel adjacent particular burner ports as may be desired. Notably, while a flat plate can be punched or drawn easily, it is rather more difficult to produce an outward blister or rib in a tube burner.

Although pan burners have been designed for modest angles of inclination, the design of gas manifolds to deliver combustible gas at different levels within a firebox requires some care in light of buoyancy effects. A combustible gas, such as natural gas, less dense than the surrounding ambient air will have a tendency to collect in the highest regions of the burner first, and may resist distribution to lower regions. Conversely a gas of greater density, such as propane, may pool in the lower regions of a burner, and produce an unsatisfactory flame pattern at raised locations. Restriction of port size in one area of a burner to offset buoyancy effects may also limit the ability to produce a desired appearance at that, or other locations. Such a restriction may also not be advantageous for a change to a fuel of different density, or to a different proportion of primary air.

Single inlet gas burners are well known. One disadvantage of such burners is that, by their nature, they deliver only one mix of combustion gases for all parts of the burner. The mix of gases delivered depends on the extent to which primary air is introduced into the gas stream. Typically, the amount of entrained primary air is controlled by a valve between the gas supply main and the manifold. At present the mix is uniquely determined for the entire burner by the setting of that valve. However, one may wish to use a relatively rich fuel mix in some regions of the burner, and a lean mix in others. In the one case a large, more yellow flame may result, in the other a hotter flame may be desired for heating ember materials to produce a glow.

It is known, as for example in Whittaker, above, and in U.S. Pat. No. 4,305,372 issued Dec. 15, 1981 to Hahn, to use two separate gas manifolds, each with its own inlet. Hahn permits the use of separate valves to control burners for cooking. In these burners the introduction of gas into each separate burner chamber has no effect on the distribution in any of the other burner chambers.

There is, therefore, a need for an improved burner and display apparatus for gas fireplaces and similar devices.

SUMMARY OF THE INVENTION

In one aspect of the invention there is a gas burner having a body having an internal plenum. The body has an inlet for receiving gases from a source of combustion gases. The inlet is in fluid communication with the plenum. The body has a metal sheet and has an outlet defined in the sheet whence the combustion gases can exit the plenum to be burned in a flame thereabove. The outlet has a characteristic length and a characteristic width, the In further aspects of the invention the gas burner body has a wall thickness, the outlet includes a protrusion extending outwardly from the plenum, the outlet includes an aperture having a characteristic width and a characteristic length, and the burner meets at least one of the criteria chosen from the group consisting of:

a) an hydraulic diameter of the aperture of less than the quotient obtained by dividing the length of said periphery by $\pi$.

b) the protrusion extends outwardly of the body a distance in the range of 0.7 to 20 times the wall thickness;

c) the protrusion extends outwardly of the body a distance in the range of 0.5 to 50 times the characteristic width;

d) the outlet is designed for a gas burner port loading in the range of 7000 to 60,000 BTU/hr per square inch;

e) the outlet is designed, at ISA standard conditions, for a mean exit gas velocity greater than 12 inches per second; and f) the outlet is an elongate aperture having an aspect ratio of length to width in the range of 2 to 200.

In another aspect of the invention there is a burner comprising a body having a plenum contained therewithin; an inlet for delivering combustible gases from a supply of combustible gas to the plenum; the plenum having a first region, a second region and a third region between and in fluid communication with the first and second shelf portions; the intermediate portion canted with respect to each of the first and second shelf portions; the first and second shelf portions each having at least one opening for permitting egress of the gas from said plenum. In a further aspect of the invention each of the first, second and third regions has a length and a width defining respective first, second and third planes; the first plane intersects the third plane; and the third plane intersects the second plane.

In yet another aspect of the invention there is a burner comprising a body having a plenum contained therewithin; a first inlet for delivering combustible gas from a supply of combustible gas to the plenum; and a second inlet for delivering combustible gas from a supply of combustible gas to the plenum, the plenum having at least one opening for permitting egress of the gas from the plenum. In still another aspect of the invention at least one of the first inlet and the second inlet is provided with a valve for admitting primary air whereby the ratio of combustible gas to the primary air delivered by the first inlet to the plenum may be different from that delivered by the second inlet. In a yet further aspect of the invention the plenum has a first region and a second region in fluid communication therewith, each of the first and second regions has at least one opening for permitting egress of the gas from each respective region of the plenum; the first inlet being located to deliver combustible gas to the first region; the second inlet being located to deliver combustible gas to the second region. In another aspect the plenum comprises a third region intermediate, and in fluid communication with, said first and second regions, the third region being canted relative to each of said first and second regions.

In a still further aspect of the invention there is a simulated solid fuel element for co-operation with a burner of a gas fireplace, said simulated solid fuel element comprising: a body having at least one surface formed to simulate the appearance of a real solid fuel element; the body having at least one filament secured thereto, that filament extending outwardly of the surface for interaction with exhaust gases from the burner, whereby the exhaust gases from the burner may heat said filament to incandescence. In associated aspects of the invention the solid fuel element meets at least one of the conditions chosen from the set consisting of:

a) the solid fuel element is in the form of a log;

b) the surface includes a simulated charred area and the filament extends outwardly from the simulated charred area;

c) the filament is part of a skein of filaments having a root embedded in the body;

d) the filament has at least one end integrally molded into the body;

e) the filament is formed from a material chosen from the set of
   i) stainless steel,
   ii) steel wool,
   iii) rock wool, and
   iv) spun glass;

f) the filament has a diameter in the range of 0.0002 inches to 0.020 inches;

g) the filament extends outwardly from the surface a distance in the range of 0.040 to 0.500 inches;

h) the filament is one of a plurality of filaments in a filament array, that array having a mean random filament density in the range of 2 to 20 filaments per square centimetre.

i) the filament is part of a strand located in a channel set in the surface of the solid fuel element.

In yet another aspect of the invention there is a sheet metal gas burner for a gas fireplace having a sheet metal shell defining a plenum therewithin, and structure upon which at least one simulated solid fuel element can be mounted. The metal shell has an inlet for receiving gases from a source of combustion gases. The inlet is in fluid communication with the plenum. The metal shell includes a metal sheet and at least one outlet defined in the sheet whence combustion gases can exit the plenum to be burned adjacent to the simulated solid fuel element. The outlet has an at least partially reinforced periphery.

In an additional feature of that aspect of the invention the outlet has a characteristic width and a characteristic length greater than the characteristic width. The periphery is reinforced at least partially along the characteristic length dimension.

In a further additional feature of that aspect of the invention the periphery is reinforced by a rib adjacent thereto.

In still a further additional feature of that aspect of the invention the burner comprises at least one stiffening rib formed in the metal sheet, and protruding outwardly thereof relative to the plenum. The outlet is defined in at least part of the stiffening rib.

In yet another additional feature of that aspect of the invention the rib has a length aligned with the length of the outlet. The outlet is formed centrally along the rib.

In still another additional feature of that aspect of the invention there is a gas burner for producing flames in a gas fireplace display, wherein the metal sheet has a wall thickness. The outlet includes a protrusion extending outwardly of the sheet relative to the plenum, and an aperture defined in the protrusion and having a characteristic width and a characteristic length greater that the width. The protrusion is selected from the group of protrusions consisting of (a) protrusions extending a distance in the range of 0.7 to 20 times the wall thickness and (b) protrusions extending a distance in the range of 0.5 to 50 times the width.

In still yet another additional feature of that aspect of the invention there is a gas burner wherein the shell includes a top sheet and a bottom sheet having peripheral edges, and joined by folding their respective edges together.

In a further additional feature of that aspect of the invention there is a gas burner wherein the burner is chosen from the group of burners consisting of (a) burners having a port loading in the range of 7,000 to 60,000 BTU/hr per square inch and (b) burners having, at ISA standard conditions, a mean exit gas velocity greater than 12 inches per second.

BRIEF DESCRIPTION OF THE DRAWINGS

FIGS. 5*a*, 5*b*, 5*c*, and 5*d*, shows four alternative embodiments of burner port stiffening for the stepped pan burner of FIG. 4.

FIG. 6, being FIGS. 6*a* and 6*b*, shows details of the placement of filaments relative to one embodiment of the log set of FIG. 3.

BEST MODE FOR CARRYING OUT THE INVENTION

Figure 1:
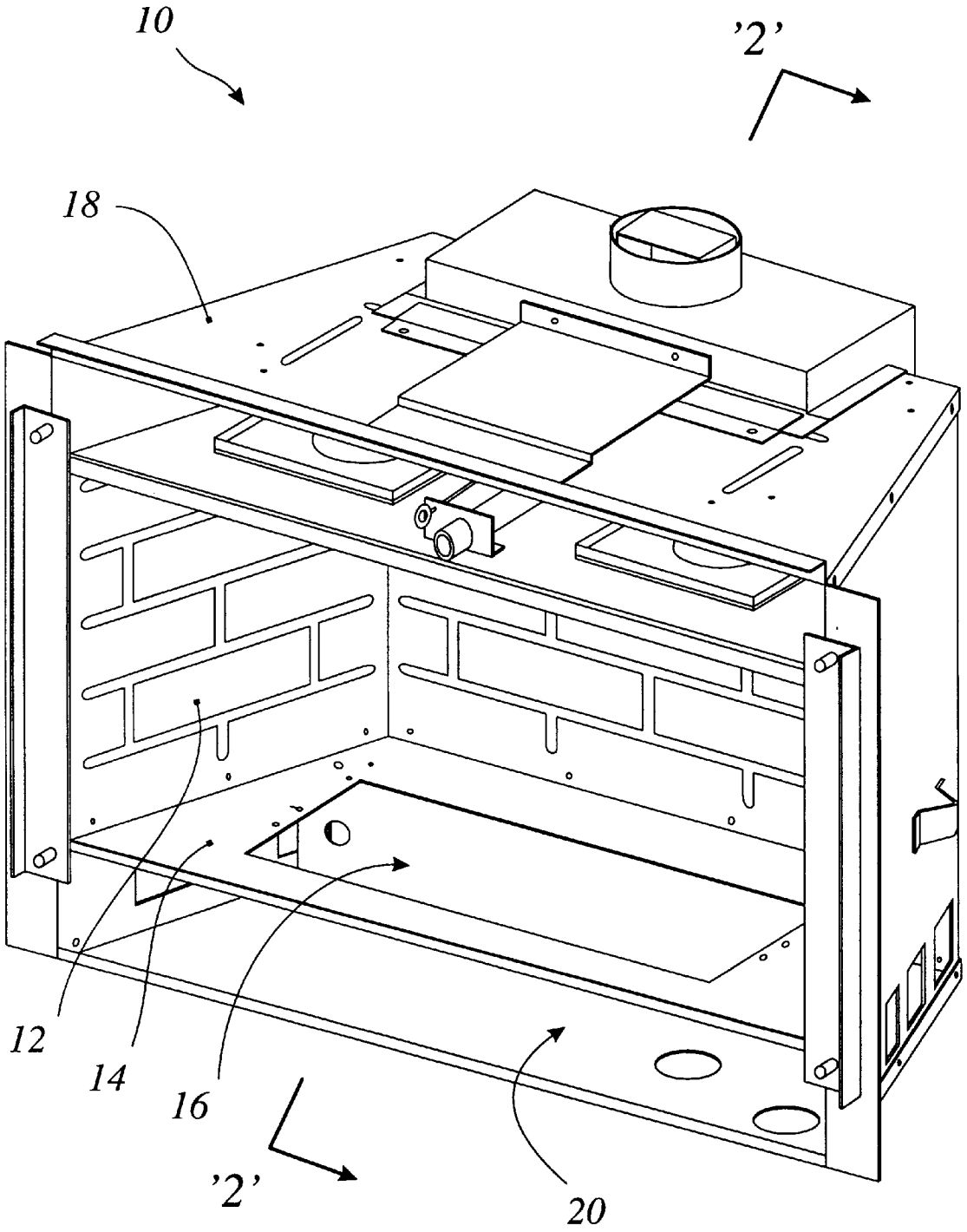
FIG. 1 is a general arrangement view of a fireplace assembly suitable for incorporating an embodiment of the present invention.

In the description which follows, like parts are marked throughout the specification and the drawings with the same respective reference numerals. The drawings are not necessarily to scale and in some instances proportions may have been exaggerated in order more clearly to depict certain features of the invention.

Referring to FIGS. 1, a gas fireplace assembly is shown generally as 10. It has a firebox, 12, having sidewalls, a rear wall, a top wall with flue, and a front opening to permit viewing of a fire therewithin. Firebox 12 has a floor 14 on which to mount a burner, floor 14 having an opening 16 therein suitable for receiving a burner and associated control hardware. The control hardware and gas train are not shown. They are of conventional design and are ultimately connected to an external source of combustion gases. Firebox 12 is carried in a casing 18, also having sidewalls, a rear wall, a top wall, a bottom wall a flue, and a frontal opening for permitting both the installation of firebox 12 and the viewing of a fire therein. Although a conventional flue fireplace is shown, and the fire draws its combustion air from room ambient, the use of a directly vented firebox having external air intake would not alter the nature of the present invention. Firebox 12 is suspended within casing 18 in a manner to leave an ambient room-air passage 20 by which room air circulating therethrough may be heated.

Figure 2:
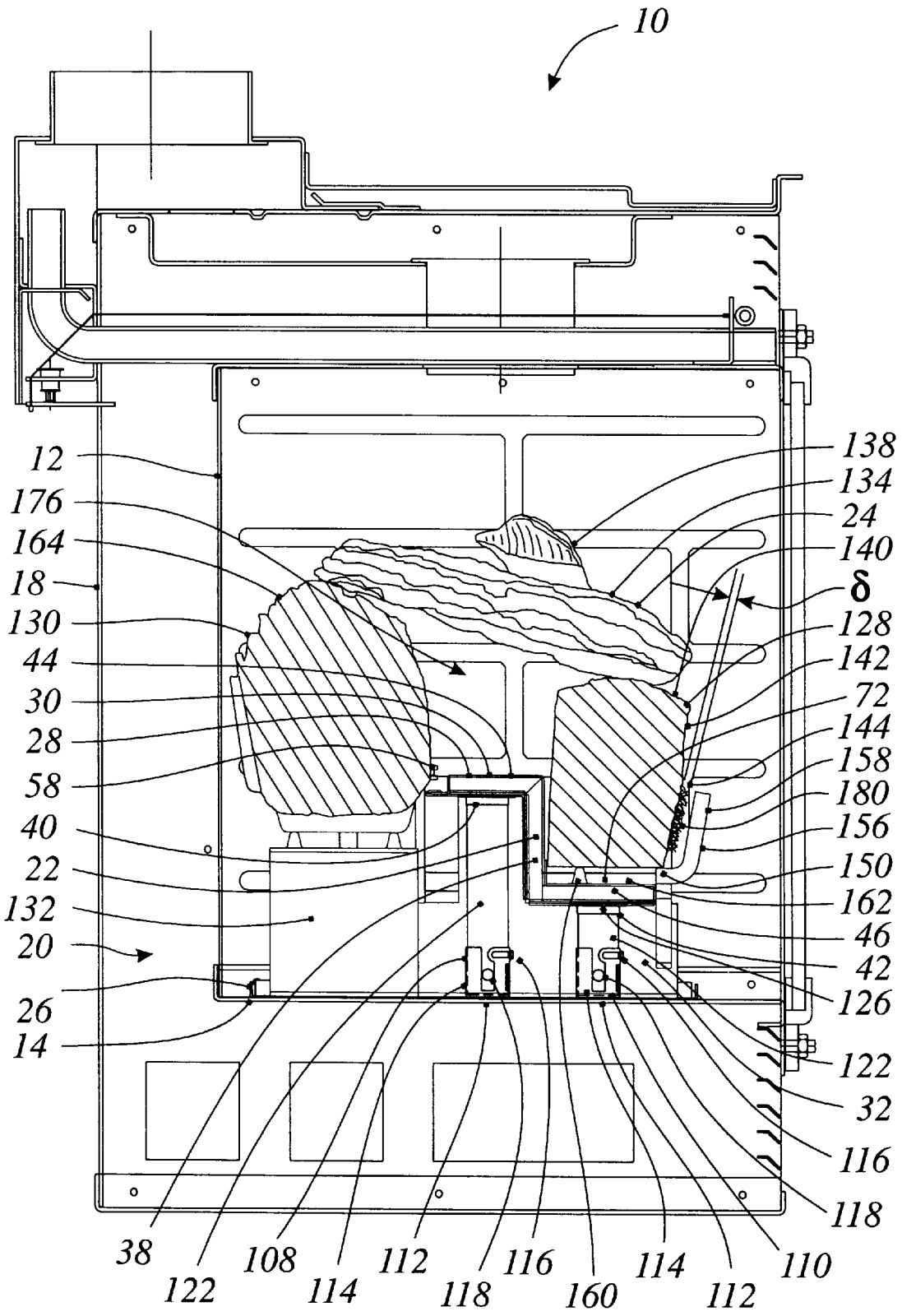
FIG. 2 is a view on cross section '2—2' of the fireplace assembly of FIG. 1 with a burner and simulated log display installed therein.

Gas fireplace assembly 10 is shown in cross section in FIG. 2, with a burner assembly 22, and a simulated fire display in the nature of a simulated soft ceramic log set 24 located thereupon. The simulated fire display could be a simulated coal fire and could be of higher density ceramic, concrete, or other suitable material. Burner assembly 22 is provided with support structure in the nature of a burner tray 26, for location upon firebox floor 14. Burner assembly 22 includes a burner manifold 28 in the form of a stepped pan burner 30. Stepped pan burner 30 is supported by left and right hand angle brackets 32 affixed to tray 26

Burner manifold 28 has a body 34, in the form of a sheet metal shell 36, with an internal plenum 38 contained therewithin, itself having a first inlet 40, and a second inlet 42 which receive combustible gases from the conventional gas control and gas train noted above; a first region in the nature of a first shelf portion 44; a second region in the nature of a second shelf portion 46; those first and second regions being in mutual fluid communication via a third region 48, being an intermediate portion, in the nature of a perpendicular riser 50 between and in fluid communication with said first and second shelf portions 44 and 46. Each of first and second shelf portions 44 and 46 is provided with at least one opening for permitting the egress of combustible gas therefrom in the form of a gas jet such that, when lit, the jet will produce a flame within firebox 12 in the neighbourhood of the simulated fire display of log set 24. For example, in the embodiment illustrated in FIG. 4, shelf portions 44 and 46 are each provided with respective burner port arrays 52 and 54. Intermediate portion 48 need not be perpendicular to shelf portions 44 and 46, and may itself have one or more openings for permitting the egress of combustible gas to produce a desired flame pattern. In the embodiment shown, the intermediate portion is provided with a linear array of flame carry-over ports 56 to provide an ignition path between array 52 and array 54. A pilot 58, suitably concealed in the midst of the simulated fire display, log set 24, behind burner manifold 28, and only partially visible in FIG. 2, provides the initial ignition source.

Sheet metal shell 36 is formed from three folded sheet members, with reduced need for welding. The three sheet metal members are a first sheet member, being upper top sheet 60, a second sheet member, being lower top sheet 62, and a third sheet member, being bottom sheet 64. Upper top sheet 60 has two major portions, those being a top burner panel 66 and a riser panel 68, those panels meeting along a downward bend line 70. Top burner panel 66 has depending flanges 66*a*, 66*b*, and 66*c* about its remaining peripheral edges. Riser panel 68 has rearwardly folded wings 68*a* and 68*b* on opposite sides thereof, and, on the remaining side terminates in a downwardly extending straight-edged skirt 68*c*. Lower top sheet 62 has a major portion, lower burner panel 72, which terminates rearwardly in an upwardly extending flange 72*a*, for mating engagement with skirt 68*c*, and laterally and forwardly with peripheral downwardly bent flanges 72*b*, 72*c*, and 72*d*.

Bottom sheet 64 has three major portions, being a first burner wall 74, a second burner wall 76 and an intermediate riser wall 78 between and adjoining burner walls 74 and 76 at bend lines 80 and 82 respectively. First burner wall 74 has foldable peripheral wings, or tabs, 74*a*, 74*b*, and 74*c* for folding engagement with flanges 66*a*, 66*b*, and 66*c* respectively, of top burner panel 66. Intermediate riser wall 78 has foldable wings, or tabs, 78*a* and 78*b* for folding engagement with rearwardly folded wings 68*a* and 68*b*, respectively, of riser panel 68. Second burner wall 76 is similarly provided with peripheral wings, or tabs, 76*a*, 76*b* and 76*c* for folding engagement with flanges, 62*a*, 62*b*, and 62*c*, respectively, of lower top sheet 62.

Figures 4, 4A, 4B, 4C:
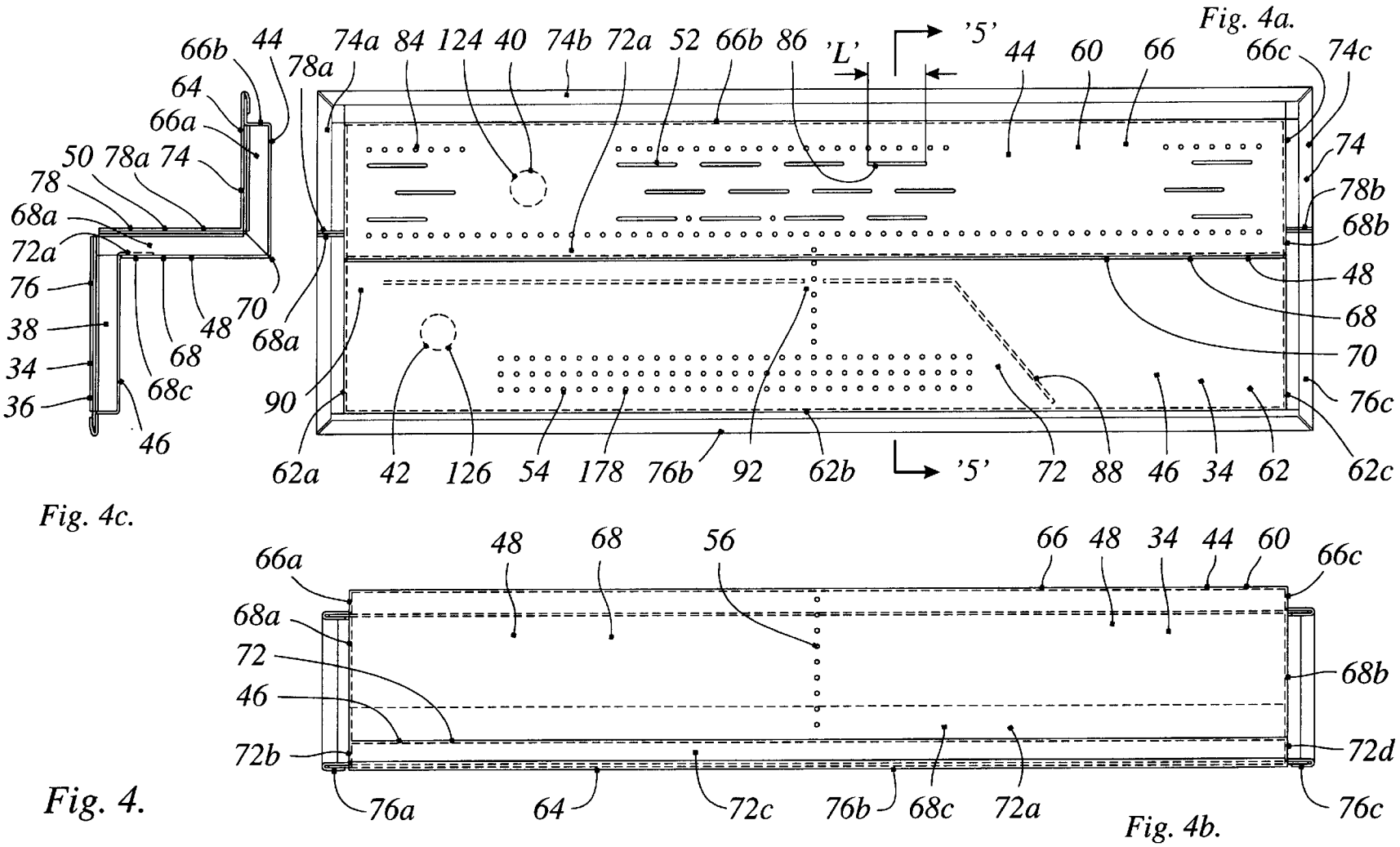
FIG. 4, being
FIGS. 4*a*, 4*b*, 4*c*, and 4*d*, shows, respectively, top, front elevation, profile and quarter views of the stepped pan burner of FIG. 2.
Figure 4D:
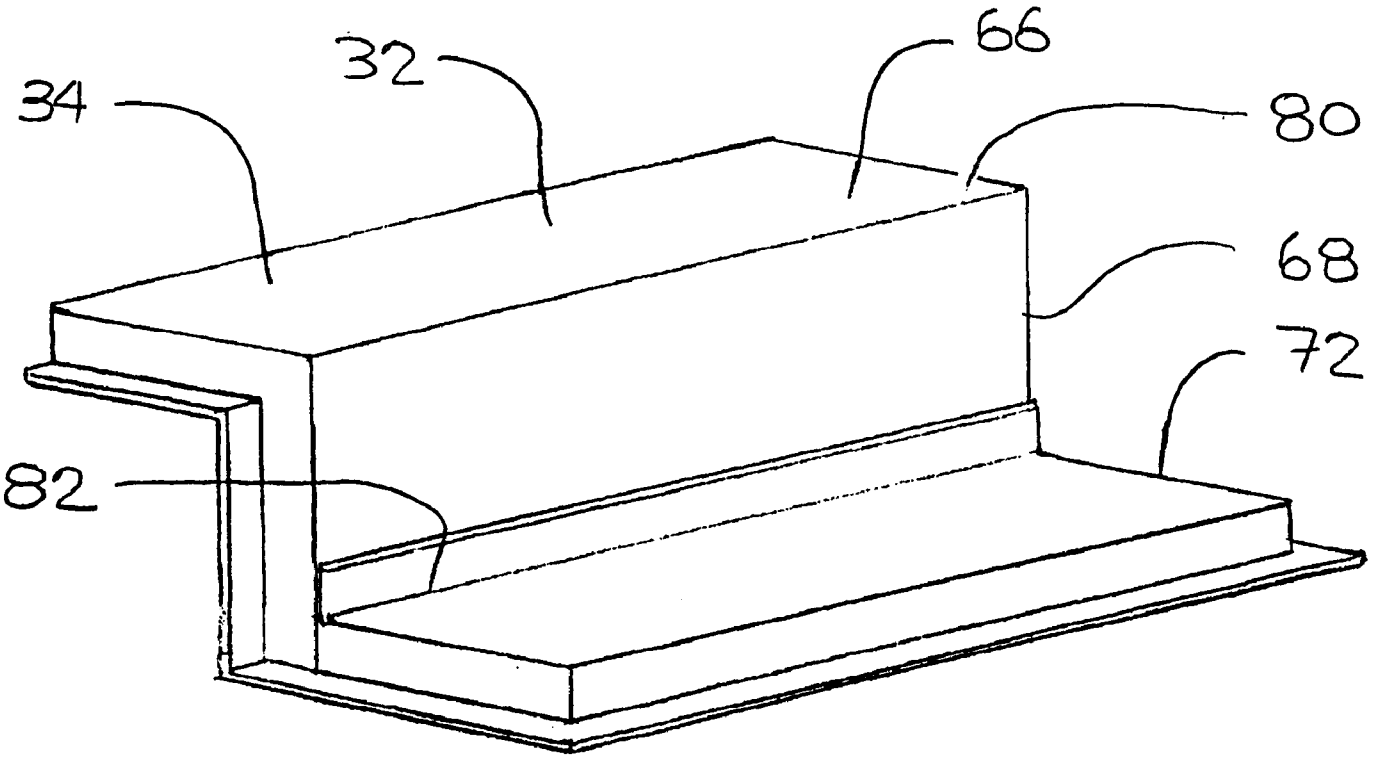

Once folded, the resulting, hollow, body 34, in the form of sheet metal shell 36 has a general form as shown in FIG. 4*d*, in which burner porting has been omitted for purposes of simplicity. Top burner panel 66 lies substantially in a first plane, lower burner panel 72 lies substantially in a second plane, and riser panel 68 lies substantially in a third plane. The first and third planes intersect at bend line 80 and the second and third planes intersect at bend line 82. As shown the first, third, and second planes define a Z-section with parallel legs and a perpendicular web, but the legs, being the first and second planes, need not be parallel, and the web need not be perpendicular to either leg, but could be at 150, 135, 120 degrees or any other convenient angle.

Except for intentionally made porting, a sheet metal box, such as shell 36, can be made that is substantially airtight with a reduced requirement for welded seams, and only minor requirements for sealant or gasketting. Furthermore, sheet metal boxes of this nature can be produced relatively rapidly, inexpensively and accurately in a largely automated process, and, since sheet metal forming, cutting, and stamping machines are used, the pattern of arrays 52 and 54 may be adjusted in production with relative ease. Another advantage, to be described more fully below, is that it permits local deformation of panels 66, 68, and 72 by drawing, punching extruding or other like means to produce ribs, dimples, flanges and other structural features, before assembly.

Array 52 in upper burner panel 66 includes a plurality of circular holes 84 and a pattern of elongate slots, one of which is indicated as opening 86. These slots are used to produce a larger flame which appears to stand higher above the burner, and to extend higher, than is the case for flames emanating from the smaller holes. It has been observed that the smaller holes tend to yield smaller flames whose bases remain close to the burner. A final detail, shown in hidden lines in FIG. 4*a*, is an internal baffle 88 for encouraging combustible gas to exit through burner port array 54. Baffle 88 may have many different forms, and may include a gap 90 near inlet 42 or a gap 92 for encouraging flow of gas to carry-over ports 56, the presence or absence of baffle 88 and gaps 90 and 92 will depend on the specific burner port arrays chosen and the flame pattern desired.

Figure 5:
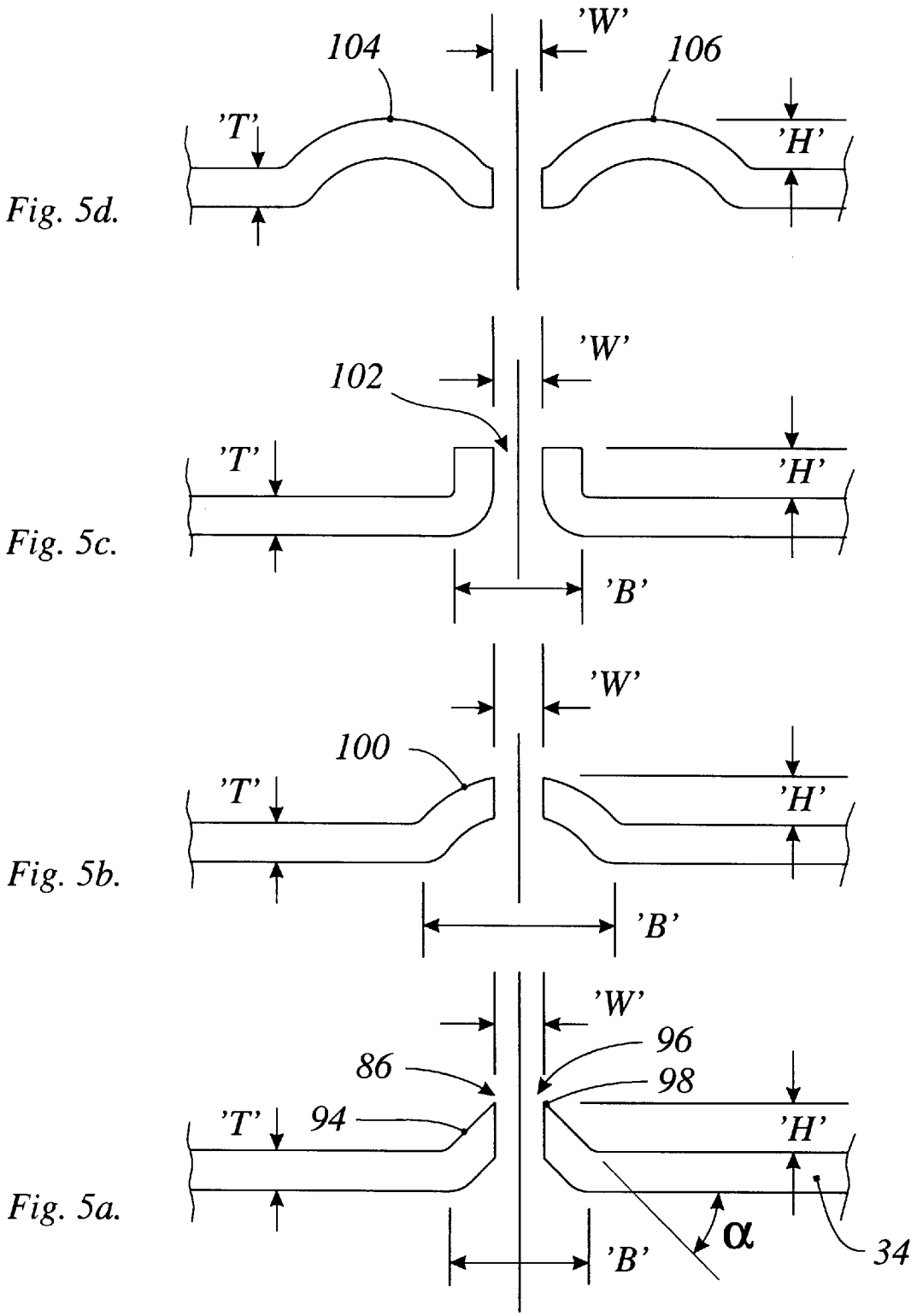
FIG. 5, being

FIG. 5 shows four alternative cross sections of opening 86 taken on section '5—5' of FIG. 4*a*. In the presently employed embodiment, that of FIG. 5*a*, opening 86 is made in a rib 94 protruding outwardly of body 34 that rib having a generally V-shaped cross section, a base width 'B', and a height 'H'. An aperture 96 has been made along the vertex or spine 98 of the V. In the preferred embodiment the shell thickness, indicated as 'T' is nominally 1.2 mm, or roughly 0.040 inches, height 'H' is nominally 1.5 mm, or roughly 0.06 inches, and the inclination of the V, shown as $\alpha$, is 45°. Aperture 96 has a slot width 'W' of 1.524 mm, again, roughly 0.06 inches, and a length, 'L', of 25.4 mm or 1.00 inch. The base width 'B' is roughly 4.6 mm or 0.180 inches. The hydraulic diameter of aperture 96, defined as four times the ratio of the area to the length of the perimeter, the slot is 0.113 inches, and its aspect ratio is 16.6.

FIG. 5*b* illustrates a blister 100 made with a rounded, as opposed to a 'V' shaped tool, FIG. 5*c* illustrates a cross section of an aperture with walls folded back to form a parallel vertical channel 102. FIG. 5*d* illustrates an aperture bordered by two adjacent ribs 104 and 106, which provide local reinforcement. It is preferable that, if provided, stiffening be provided in at least the longitudinal direction of the slot, that is to say, with the long axis or the rib or other stiffener parallel to the long axis of the aperture. In addition to any structural benefit obtained from local reinforcement adjacent the aperture, in the view of the inventors the provision of an outward flange, dimple, bulge, blister, or rib, appears to produce an aesthetically more attractive flame under some circumstances.

Returning to burner manifold 28, the use of both first inlet 40 and second inlet 42 encourages even distribution of combustible gases throughout internal plenum 38. Inlets 40 and 42 are each provided with an inlet valve, 108 and 110 respectively, for receiving combustible gases from a gas control unit and pressure regulator of known design (not shown, as noted above), and delivering it to internal plenum 38. The gas control unit receives combustible gas from an external source. Each of valves 108 and 110 includes an inlet 112 for receiving gas from an orifice of the gas control unit, a rotary shutter 114 whose variable position is controlled by a screw 116, a primary air intake port 118, and a riser 122 which mates with a gas port 124 or 126 of inlet 40 or 42 respectively, to deliver combustible gas to the first or second regions, being first and second shelf portions 44 and 46, respectively. Suitable adjustment of each rotary shutter 112 of valves 106 and 108 will yield differing lean and rich air and fuel mixtures at inlets 40 and 42. Additional internal baffling may be provided near the mouths of inlets 40 and 42 as required.

Figure 3:
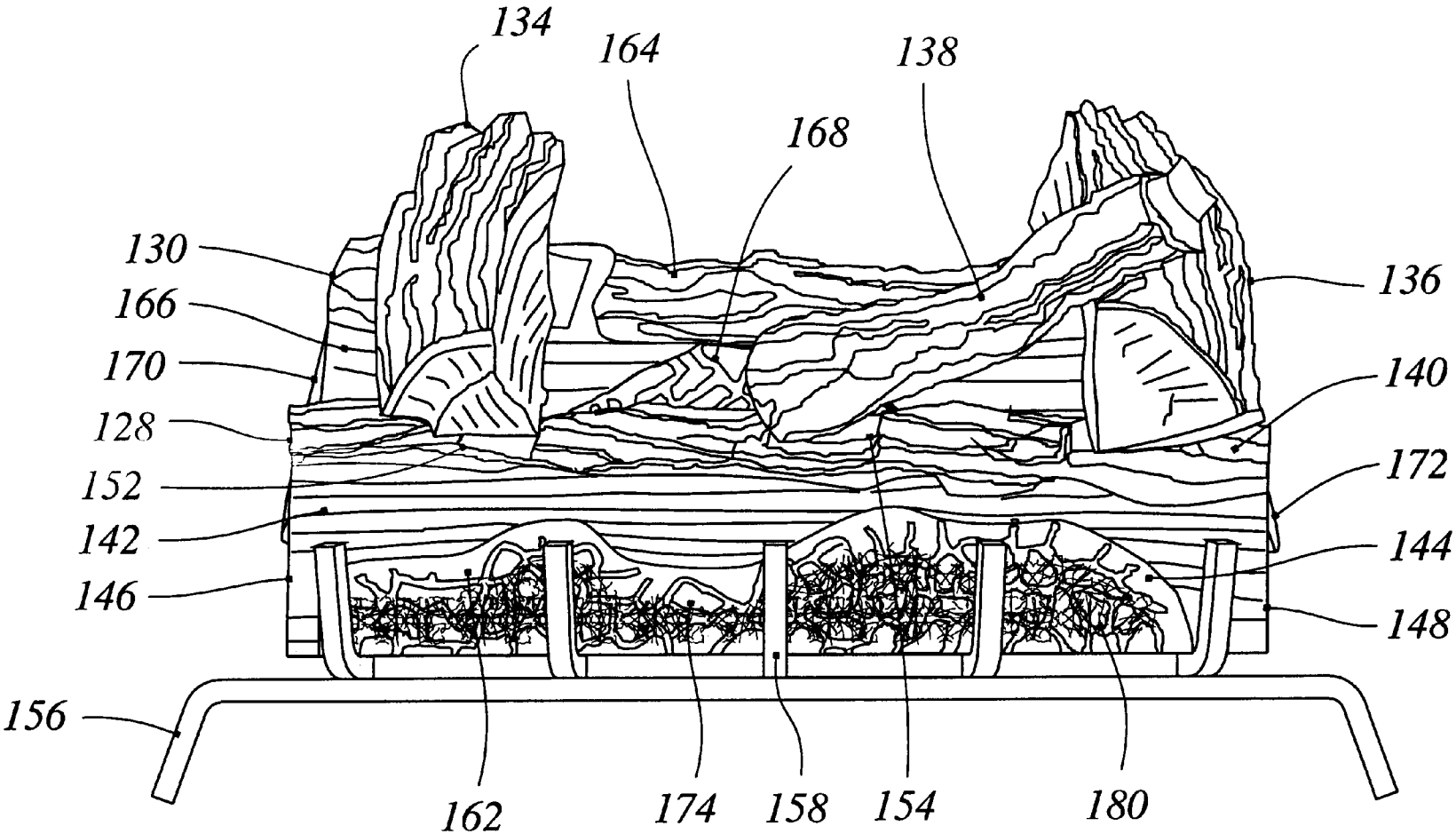
FIG. 3 shows a front view of the log display of FIG. 2.

Log set 24 is shown in FIGS. 2 and 3. As shown it includes a lower, front main log 128 for location above lower burner panel 72, an upper, rear main log 130 for location atop left and right hand support brackets 132, and rearwardly of top burner panel 66, a left hand cross piece 134 for location on logs 128 and 130, a right hand cross piece 136, and a diagonal cross piece 138 all for location on logs 128 and 130. A sixth log, or ember strip for placement in front of front main log 128 could also be included for the purposes of generality, but is not illustrated. In general the choice of the number of logs, the presence of ember materials on or in front of the burners, and the arrangement of those logs in two tiers or three tiers, and many other features may vary without affecting the applicability of the principles of the invention set out herein.

The following description of main logs 128 and 130 is intended to be generally applicable to all simulated logs. Front main log 128 has an upper, predominantly dark brown bark simulating region 140, a cream or beige region 142 to simulate a split wood surface, a blackened region 144 to simulate a charred surface, and a cut end regions 146 and 148 on either end to give the appearance of sawn firewood. Each of regions 140, 142, 144, 146, and 148 has a texture and colour pattern appropriate to its role. Other features of log 128 include pickup points 150 for alignment on burner manifold 20, and locating pads 152 and 154 for logs 132, 134, and 136. These features, locating points on burner manifold 28, grilles, andirons and other common fireplace features are well known in the art. A simulated grate 156 is provided having upturned tines 158. The base of tines 158 and standoffs 160, or equivalent, sit under log 128 to give an air space 162 above lower burner panel 72. Rear main log 130 has corresponding bark simulating, split wood simulating, blackened, and sawn regions 164, 166, 168, 170 and 172.

It is intended that only portions of logs 128 and 130 lying within respective blackened regions 144 and 168 be subjected to sufficient heating to cause glowing. Each of blackened regions 144 and 168 has protruding pads 174 which, when glowing, provide an appearance not unlike that of glowing charcoal. As seen in FIG. 2, logs 128 and 130 are shaped and located to leave a gap 176 behind at least a portion of log 128 in front of log 130 As can be seen in the front view of log set 24 provided in FIG. 3, blackened region 144 has a larger visible area than blackened region 168. Region 168 is at least partially hidden from view behind log 128, as is upper burner panel 66. In the view of the inventors, the visual attractiveness of the fire is enhanced by encouraging relatively large flames to rise in gap 176 which give the appearance of an ample blaze, and by enhancing the orange and red glow given off by the relatively larger and more prominent blackened region 144 of log 128. In part this enhancement is achieved by altering the air-fuel mix entering through inlet 42, and by a different array of apertures, such as holes 178 of array 54.

According to the principles of the present invention the glow of region 144 can also be enhanced by mounting a skein of filaments 180 directly to region 144, whether by introduction in the mold, by mechanical insertion or other means. Direct mounting to the glowing surface avoids the installation difficulties of maintaining gap width tolerances. The filaments may be mounted to lie more or less against the exposed front face of region 132, or may extend outwardly therefrom into the gas path of the hot exhaust gases. The optimal distance of this extension, indicated as δ in FIG. 2, will depend on the burner and log geometry chosen. It should be noted that the representation of filaments 180 in FIG. 2 is exaggerated for the purpose of illustration. Satisfactory results have been obtained with δ being less than 5 mm, or roughly 0.200 inches, and also at less than 2 mm (roughly 0.040 inches). FIG. 6 shows a preferred embodiment of the invention. FIG. 6*a* shows a partial front view of log 128. As before a number of charcoal simulating protruding pads 174 are shown, separated from each other by irregularly shaped channels 182, shown in cross-section in FIG. 6*b*. Strands of filament 184 have been placed in channels 182. The number of strands in any given channel need not be large, a satisfactory appearance being achieved with fewer than half a dozen to two dozen strands.

Filaments 180 and 184 are very thin, being of the order of 0.001 to 0.010 inches in diameter. Smaller or larger diameters may also prove satisfactory. Filaments 180 and 184 are not unduly obtrusive when the fire is out. The filaments need not be of round cross section. They may be of stainless steel, rock wool, or other suitable material. The inventors have obtained satisfactory results with 434 series stainless steel shavings which are available in coarse, medium and fine grades, the medium grade having thicknesses indicated as lying in the range of 0.007 to 0.0095 inches.

Under steady state operating conditions pads 174 of regions 144 and 168 tend to glow in a uniform, hardly varying manner, particularly if a stable hot flame pattern develops, as opposed to a flickering flame pattern. Filaments, whether as a skein of filaments 180, or as a strand of filaments 184, each having very small thermal mass, are sensitive to relatively small changes in local exhaust gas temperature and velocity, heating and cooling rapidly as the flame pattern wavers, with consequent relatively rapid variation in their incandescent behaviour. The filaments also appear capable of glowing in the presence of relatively cooler, yellower flames than customarily used by the inventors to cause the blackened regions to glow previously.

The quantity of incandescent filament used, and its location, is a matter of some discretion. However the present inventors have used very loosely spaced steel wool to produce attractive results, with a density in the order of 10 filaments per square centimetre (that is, in a square centimetre chosen at random one will on average, count part or all of 10 filaments). Filaments 180 or 184 could also be provided for other logs and in other locations as desired without departing from the spirit or scope of the present invention.

Various embodiments of the invention have now been described in detail. Since changes in and or additions to the above-described best mode may be made without departing from the nature, spirit or scope of the invention, the invention is not to be limited to those details, but only by the appended claims and their equivalents.

We claim:

1. A sheet metal pan burner comprising:

a folded sheet metal body having an internal plenum defined therewithin;

said body having an inlet for receiving gases from a source of combustion gases, said inlet being in fluid communication with said plenum;

said body having a metal sheet surface portion, said metal sheet surface portion having a planar surface and a plurality of reinforcements formed in the midst of said sheet metal surface portion, said reinforcements each having an outlet defined therein whence the combustion gases can exit said plenum to be burned in a flame thereabove, said outlet having a characteristic length and a characteristic width, said length being greater than said width, the ratio of said length to said width lying in the range of 2 to 200;

said outlet having a periphery, said periphery being at least partially stiffened by said reinforcement;

said sheet metal surface portion having a sheet metal thickness;

said reinforcements including protrusions extending outwardly of said planar sheet metal surface portion, relative to said plenum, a distance that is (a) in the range of 0.7 to 20 times said sheet metal wall thickness, and (b) in the range of 0.5 to 50 times said width of said outlet; and said burner being operable to support flames above said outlet at a port loading in the range of 7,000 to 60,000 BTU/hr per square inch.

2. A gas burner as claimed in claim 1, for use in a simulated fire display having simulated solid fuel elements, wherein said body is a sheet metal shell that includes said metal sheet, said periphery is reinforced at least partially along said characteristic length dimension; and said outlet is located to produce a flame adjacent to at least one of the simulated solid fuel elements.

3. A gas burner as claimed in claim 1 wherein said reinforcement includes at least one stiffening rib in the nature of a blister formed in the midst of said metal sheet; and said outlet includes an aperture defined in at least part of said stiffening rib.

4. A gas burner comprising:

a body having an internal plenum;

said body having an inlet for receiving gases from a source of combustion gases, said inlet being in fluid communication with said plenum;

said body having a metal sheet and having an outlet defined in said sheet whence the combustion gases can exit said plenum to be burned in a flame thereabove, said outlet having a characteristic length and a characteristic width, said length being greater than said width;

said outlet having an at least partially reinforced periphery; and said periphery is reinforced by at least one rib adjacent to said outlet.

5. A burner comprising:

a body having a plenum contained therewithin;

said body having first and second inlets for delivering combustible gas from a supply source to said plenum, at least one of said inlets having an adjustable valve for admitting primary air; and said plenum having at least two outlets for permitting egress of said gas from said plenum, whereby the ratio of combustible gas to primary air can differ between said inlets;

and wherein said plenum has a first region and a second region in fluid communication therewith;

each of said first and second regions has at least one of said outlets for permitting egress of said gas from each respective region of said plenum;

said first inlet being located to deliver combustible gas to said first region; and said second inlet being located to deliver combustible gas to said second region.

6. A burner as claimed in claim 5 wherein said plenum comprises a third region intermediate, and in fluid communication with, said first and second regions.

7. A burner as claimed in claim 6 wherein said third region is canted relative to each of said first and second regions.

8. A burner according to claim 6 wherein said burner is formed of sheet metal.

9. A sheet metal gas burner for a gas fireplace, comprising:

a folded sheet metal shell defining a plenum therewithin, and structure upon which at least one simulated solid fuel element can be mounted;

said metal shell having an inlet for receiving gases from a source of combustion gases, said inlet being in fluid communication with said plenum;

said metal shell including a planar metal sheet and at least one outlet defined in the midst of said sheet whence combustion gases can exit said plenum to be burned adjacent to the simulated solid fuel element; and said outlet has an at least partially reinforced periphery said outlet having a characteristic length and a characteristic width, said length being greater than said width, the ratio of said length to said width lying in the range of 2 to 200;

said outlet having a periphery, said periphery being at least partially stiffened by said reinforcement;

said sheet metal surface portion having a sheet metal thickness;

said reinforcements including protrusions extending outwardly of said planar sheet metal surface portion, relative to said plenum, a distance that is (a) in the range of 0.7 to 20 times said sheet metal wall thickness, and (b) in the range of 0.5 to 50 times said width of said outlet; and said burner being operable to support flames above said outlet at a port loading in the range of 7,000 to 60,000 BTU/hr per square inch.

10. A sheet metal gas burner as claimed in claim 9 wherein said periphery is reinforced at least partially along said characteristic length dimension.

11. A gas burner as claimed in claim 10 wherein said periphery is reinforced by a rib adjacent thereto.

12. A gas burner as claimed in claim 10 wherein said burner comprises at least one stiffening rib formed in said planar metal sheet, said rib protruding outwardly relative to said plenum; and said outlet is defined in at least part of said stiffening rib.

13. A gas burner as claimed in claim 12 wherein said rib has a length aligned with the length of said outlet, and said outlet is formed centrally along said rib.

14. A gas burner as claimed in claim 9 wherein said shell includes a top sheet and a bottom sheet having peripheral edges, and joined by folding their respective edges together.

* * * * *